US006778178B1

(12) United States Patent
Laksono et al.

(10) Patent No.: US 6,778,178 B1
(45) Date of Patent: Aug. 17, 2004

(54) MEMORY RANGE ACCESS FLAGS FOR PERFORMANCE OPTIMIZATION

(75) Inventors: Indra Laksono, Richmond Hill (CA); David I. J. Glen, Toronto (CA); Philip J. Rogers, Pepperell, MA (US); Anthony D. Scarpino, Scarborough (CA)

(73) Assignee: ATI International, SRL, Barbados (KN)

( * ) Notice: Subject to any disclaimer, the term of this patent is extended or adjusted under 35 U.S.C. 154(b) by 338 days.

(21) Appl. No.: 09/710,943

(22) Filed: Nov. 13, 2000

(51) Int. Cl.[7] ..... G09G 5/36
(52) U.S. Cl. ..... 345/556; 345/531; 345/559
(58) Field of Search ..... 345/501–506, 345/519–520, 522, 530–574

(56) References Cited

U.S. PATENT DOCUMENTS 5,477,242 A * 12/1995 Thompson et al. ..... 345/132
6,115,054 A * 9/2000 Giles ..... 345/522

* cited by examiner

*Primary Examiner*—Kee M. Tung
(74) *Attorney, Agent, or Firm*—Volpe and Koenig, P.C.

(57) ABSTRACT

A graphic accelerator interface device for a computer is provided. The accelerator has a host data path that includes a plurality of comparators, each assigned to permit os/application access to a different "surface" which is defined by an address range corresponding to a block of data in a frame buffer. Unlike the prior art, an access flag register is associated with the host data path such that each surface assigned to a comparator has associated read and write flags. Whenever a read or a write occurs to one of the assigned surfaces via the host data path, the corresponding flag is set. Preferably, for os/application access, the surfaces contain data in an untiled format which the graphic accelerator uses in a tiled format. The invention affords more efficient, i.e. faster, processing, since the graphics driver can use prior tiled format data, if the write flag is clear, instead of processing the untiled data stored in an assigned surface into a useable tiled format which is only needed if the untiled data has been changed, i.e. indicted by the write flag being set.

15 Claims, 1 Drawing Sheet

MEMORY RANGE ACCESS FLAGS FOR PERFORMANCE OPTIMIZATION

This invention relates to graphic accelerator interface devices for providing a video signal output for a computer system.

BACKGROUND

Computer systems having associated video displays are well known in the art. With the advent of the ability to produce high quality detailed colored graphics, graphic accelerator interface devices have been developed to speed the rendering of the color images which are displayed. It is known in the art to either incorporate such a graphic accelerator device into a computer system directly or to provide an add-in accelerator card that provides the video signal output for the computer system.

Graphic accelerator devices contain significant amounts of auxiliary memory that is used for the rendering of graphics. While a computer's main CPU typically directs the overall display parameters for the video signal, independent graphic accelerator processors and memory perform many of the rendering tasks at high speeds so that the desired video signal is produced as quickly as possible without delay.

In order to facilitate the efficient production of a video signal, it is known to provide a sizeable frame buffer of multiple mega bytes, for example 64 mega bytes, on a graphics accelerator device which is accessible by the computer's main CPU for os/applications and is used by the graphic accelerator's processors as the basis for generating the video signal. Conventionally, the frame buffer is segmented into various blocks of data and the computer's CPU is provided access to the frame buffer via a host data path within the video interface device to a specified number of blocks within the frame buffer at any given time. The various blocks of data accessible via the host data path by the main CPU are called surfaces and typically up to eight surfaces are accessible at any given time. The address identification of the particular surfaces, as defined in the host data path, are dynamically allocated so that the system CPU can gain access to the entire frame buffer, albeit only up to a predetermined number of surfaces, such as eight, at one time.

Conventionally, when the graphics driver needs to use the data stored in the frame buffer, it reads the specific data block and reprocesses the information as needed. In a variety of instances, the graphics driver may write data into various surfaces of the frame buffer to provide access thereto to the system CPU. CPU access is provided by the host data path assigning the surface which entails assigning the surface's address location to one of several sets of comparators. Subsequent use of an assigned surface by the graphic processing circuitry conventionally requires various reinitializing processes.

In modern computer systems (such as those that employ the PC DOS operating system, PC windows system or the Macintosh operation system as examples), the graphics driver may employ a tiling format for the generated video signal, but will copy blocks of information in an untiled format to another area of the frame buffer which is required for CPU access. This entails storing the tiled format data, processing it to create an untiled version and then storing the untiled version in the frame buffer. When the frame buffer data is to be used by the graphics driver, it reads the frame buffer data stored in the untiled format and processes it into a tiled format which is stored for subsequent use. However, if the untiled format data has not been changed from the time it was originally stored in the frame buffer, the resultant tiled formatted data is the same as the original stored tiled format data from which the untiled formatted data was derived.

In computer systems employing MAC operating systems, the graphic accelerator circuitry writes synchronized data into the frame buffer. It is important that this data be synchronized between the CPU and graphic accelerator so that each device sees the same current (most recently written) data. When accessing the data from the frame buffer, the graphics accelerator will normally conduct a re-synchronizing process before use to ensure that the data is in fact the most recent. However, if the CPU has not changed the data in the format buffer which is to be reused by the graphics interface circuitry, re-synchronization is unnecessary.

Applicants have recognized that it would be desirable to devise an interface device where redundant initialization processes, such as reconverting data to a tiled format or re-synchronizing data, can be eliminated thereby reducing overall processing time.

SUMMARY

A graphic accelerator interface device for a computer is provided which has graphic processing circuitry coupled to a video signal output. The graphic processing circuitry functions under control of graphics driver software to generate a video output signal. The graphics accelerator includes a frame buffer for storing blocks of data used by the graphics driver. Access to the frame buffer is provided for the computer's main CPU for operating system (os) applications via a host data path within the graphic accelerator. External reads and writes to the frame buffer are conducted via the host data path.

The host data path includes a plurality of comparators, each assigned to a different surface. Each surface is defined by an address range corresponding to a block of data in the frame buffer. Since there can be many more surfaces then there are comparators, the comparators are dynamically assignable so that the entire frame buffer is accessible.

An access flag register is associated with the host data path, preferably having both read and write flags, each with clear and set states. A pair of flags being provided for each of the comparators. Thus, each surface assigned to a comparator has associated read and write flags. Whenever a read or a write occurs to one of the assigned surfaces via the host data path, the corresponding flag is set. Accordingly, by referencing the write flags in conjunction with accessing data in the frame buffer stored in the address range of an assigned surface, the graphics driver can determine whether the data has been changed. The graphics driver's use of the data stored in an assigned surface in the frame buffer is controlled in two different manners depending upon whether the corresponding write flag is in its clear or set state.

In a modern computer environment, the graphics driver stores blocks of data in a tiled format surface for normal use. When an os/application requests data access, corresponding tiled data is locked from normal use, processed and written into a selected surface of the frame buffer in an untiled format. The untiled surface then becomes assigned for the os/application access via the host data path. The os/application accesses the untiled copy of the surface as it desires and then informs the graphics driver that it may unlock the tiled surface data when done. Whether the graphics driver uses the untiled frame buffer surface data when it unlocks the surface is dependent upon the state of corresponding write access flag. Where the write access flag of the assigned surface is clear, the untiled data in the selected surface is unchanged, and the graphics driver ignores the frame buffer surface data and unlocks and utilizes the previously stored tiled format data. If the write access flag is set, the graphics driver reads the untiled data stored in the assigned surface from the frame buffer, processes it into the requisite tiled format and stores the new tiled version for use in a conventional manner in place of the previously stored and locked tiled data. This untiled to tiled conversion may be done either using the CPU, or by specialized hardware within the graphics accelerator if available.

In the MAC operating system environment, the graphics driver stores synchronized data into selected surfaces of the frame buffer. When one of the surfaces is assigned for os/application access via the host data path, reaccess to the data by the graphics driver is then dependent upon the state of the corresponding write access flag. Where the write access flag is clear, the graphics driver accesses the data stored in the assigned surface of the frame buffer by directly using it. When the write access flag is set, the graphics driver accesses data stored in the assigned surface in the conventional manner, i.e. resynchronizing the data before use.

After the graphics driver resynchronizes the data in an assigned surface of the frame buffer, the write flag is cleared. This can be done by the graphics driver by simply changing the state of the write access flag or by reassigning the comparator to a new surface and reinitializing the flags associated with that comparator for a newly assigned surface.

Preferably, the graphic accelerator interface device is incorporated into an add-in card having a video output port as the device's video signal output and edge card contacts as the card's CPU input. However, the video accelerator interface device can be directly incorporated into the motherboard of a computer system. In either case, if the computer system has a built-in video display, the graphic accelerator video signal output can be directly coupled to such a display.

It is an object of the invention to provide a graphic accelerator interface device where redundant initialization processes, such as reconverting data to a tiled format or resynchronizing data, can be eliminated to thereby reduce overall processing time.

BRIEF DESCRIPTION OF THE DRAWINGS

The above, as well as other objects of the present invention, will become apparent when reading the accompanying description and drawings in which.

DESCRIPTION OF THE PREFERRED EMBODIMENTS

Figure 1:
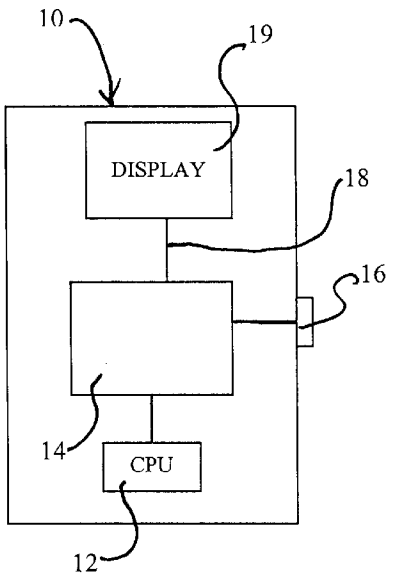
FIG. 1 is a schematic diagram of a computer system having a graphic accelerator interface device made in accordance with the present invention.

Referring to FIG. 1, there is illustrated a computer system 10 having a main CPU 12 coupled with a graphic accelerator interface device 14. The graphic accelerator interface device 14 includes either a video output port 16, a direct video output 18 or both.

The computer system 10 may optionally include an onboard display 19. In that case, the graphics accelerator 14 may be directly coupled to the display 19 via a direct video output 18. Otherwise, a video output port 16 of the graphic accelerator 14 can be used to couple the computer system 10 to an external video monitor using an appropriate cable. The graphic accelerator 14 can be incorporated into the motherboard of the computer system 10 or be provided as an add-in card as illustrated in FIG. 2.

Figure 2:
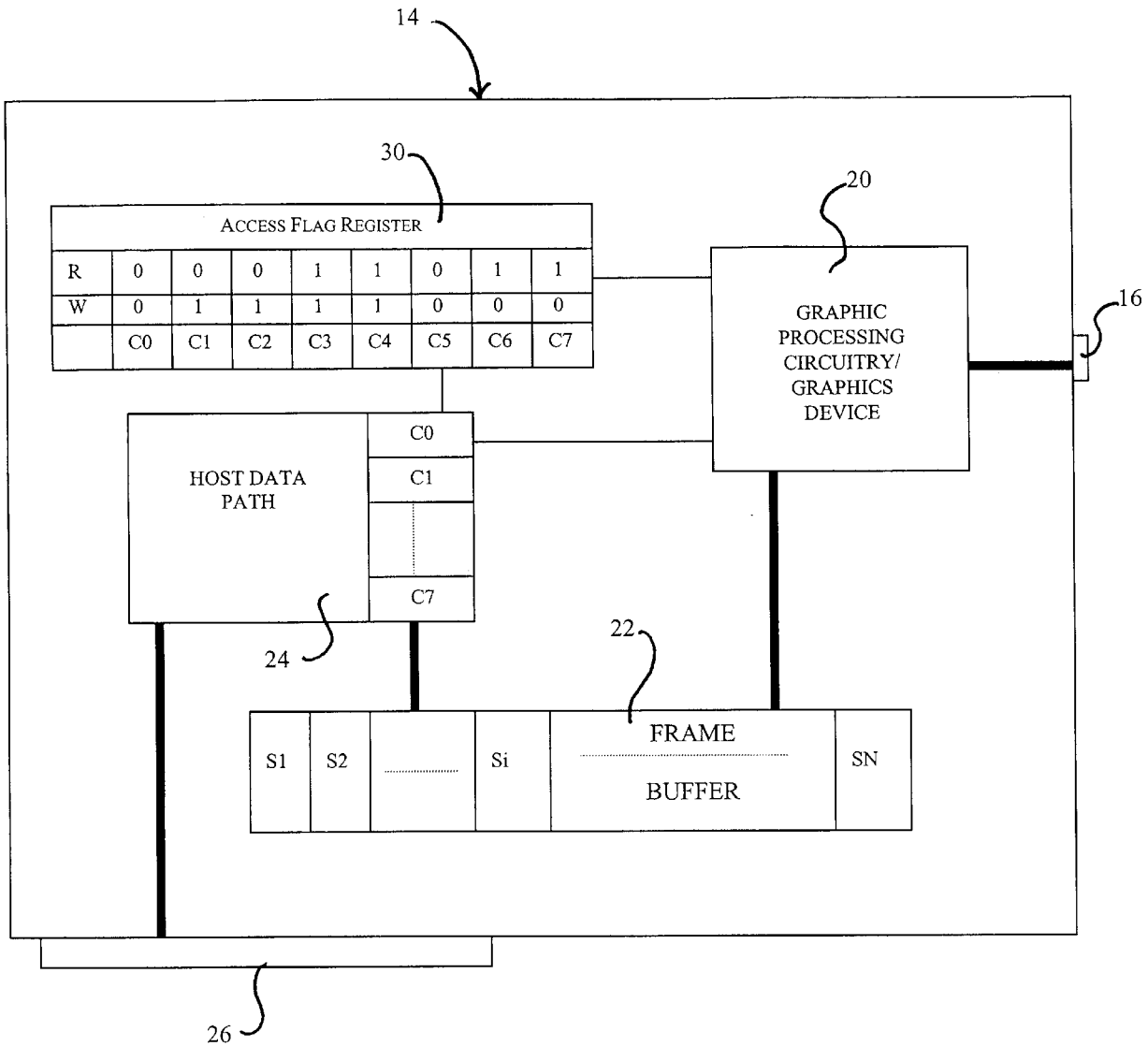
FIG. 2 is a detailed schematic diagram of the graphic accelerator interface device in accordance with the present invention configured in an add-in card embodiment.

With reference to FIG. 2, there is depicted an illustration of an add-in card embodiment of the graphic accelerator 14. The graphic accelerator 14 comprises graphic processing circuitry 20 which functions under control of graphics driver software and uses a frame buffer 22 to generate a video output signal. The frame buffer 22 may optionally be in whole or in part a separate memory in the computer system 10, since it is not physically necessary to have the graphic accelerator include all of the requisite memory on a single card. In the add-in card embodiment shown in FIG. 2, the video output signal is output via video output port 16 and/or the card may be provided with an internal video output to drive an on board display.

CPU access for os/applications to the data stored in the frame buffer 22 is conducted through a host data path 24 having an associated input 26. In the add-in card embodiment shown in FIG. 2, the host data path input 26 for the CPU, preferably, comprises contacts on a card edge which mate with an edge card connector of the motherboard of the computer system 10.

The frame buffer 22 is organized into a desired number N of blocks of data called surfaces, S1 . . . SN, having specific address ranges. Typically, the frame buffer may be on the order of 64 megabytes. The number and size of the surfaces and the overall size of the frame buffer 22 is dependent upon the specific application and the design parameters sought to be met. Each surface can be reserved for a specific type of data. For example, one surface may include font data while a different surface may include data for rendering representations of specific textures that are to be displayed.

The host data path 24 permits os/application access to the data in a limited number of surfaces of the frame buffer 22 at one time. To do this, the host data path 24 includes a plurality of comparators, preferably eight sets, C0, C1, . . . C7, which have dynamically assignable address ranges. Each comparator set has a high range comparator and a low range comparator which are assigned the highest and lowest values, respectively, of the surface address range assigned to the comparator set. In permitting os/application access to the data within a specific surface of the frame buffer 22, the host data path 24 assigns that surface to one of the comparators C0, C1 . . . C7, by dynamically assigning that comparator the address range of the assigned surface. The graphics driver preferably does this dynamic assignment.

An access flag register 30 is associated with a host data path comparators C0 . . . C7 and includes a read flag R and a write flag W for each of the comparators C0 . . . C7. When a surface assignment is made to a comparator, the corresponding read and write flags are initialized to a clear state. The clear state is preferably indicated by a zero value. Thereafter, any time any of the data within an assigned surface is read, the corresponding read access flag R is set by being given a value of one. Likewise, any time data is written into an assigned surface via the host data path, the corresponding write access flag W is set by being given a value of one. Illustrative values for the read and write flags R, W for each of the comparators C0 . . . C7 are shown in FIG. 2.

The graphics driver 20 stores data into the surfaces defined in the frame buffer 22 for various purposes. In a modern computer environment (such as a PC DOS, PC windows or Macintosh Operating system), the graphics driver stores data for surfaces in a tiled format. If an os/application requires access to the data, the graphics driver locks the tiled data surface, converts the tiled format data into untiled format, and stores the untiled format data in a particular surface Si of the frame buffer. One set of host data path surface comparators C0 . . . C7 are then assigned to this surface Si to enable the os/application to access the untiled copy of the desired data. At the same time, the write and read flags for the assigned comparator of this newly assigned surface Si are cleared.

When the os/application access to the surface Si is completed, an unlock command is issued. The graphics driver checks the write flag for surface Si. If not set, the untiled data in surface Si is abandoned and the graphics driver unlocks the original tiled surface data for normal use. If the write flag is set, time is spent converting the untiled data in surface Si back into tiled format replacing the original tiled format data, before the graphics driver may continue. Accordingly, in unlocking the tiled data surface, the graphics driver 20 only uses the untiled data in the assigned surface Si when the corresponding write flag for the assigned surface Si has been set.

The graphics driver checks the write flag associated with the comparator that has been assigned the address of surface Si. For example, if the surface Si had been assigned to comparator C1, FIG. 2 illustrates that some data in the assigned surface had been written to, the write flag W value being one for C1, but that no data in the assigned surface had been read, the read flag R value being zero for C1. On the other hand, if the surface Si had been assigned to comparator C6, FIG. 2 indicates that some data in the assigned surface had been read, the read flag R having a value one for C6, but that no data had been written to the assigned surface, the write flag W being zero for C6.

Where the corresponding write flag W has been set, i.e. value one, the graphics driver 20 uses the data in the assigned surface Si by reading the data, processing it into an appropriate tiled format and storing it in place of the previously tiled data, whereupon the graphic processing circuitry 20 can use the updated tiled formatted data. The assignment of the surface Si is then discontinued and the read and write access flags are both cleared in conjunction with the reuse of the comparator for another assignment to a surface. Accordingly, if comparator C1 was the comparator assigned to the surface Si in the example illustrated in FIG. 2, the data in the assigned surface Si would be read, processed into a tiled format, and stores as unlocked in place of the previously stored and locked tiled data and the comparator C1 reassigned to a different surface with the read and write flags for C1 being reinitialized with a value of zero.

On the other hand, where the write access flag W indicates that assigned surface Si has not been written to, such as for if surface Si is assigned to comparator C6 for the example illustrated in FIG. 2, the action of the graphics driver 20 is accelerated. In that case, the graphics driver 20 checks the write access flag W for C6 and finds that it is clear, i.e. having a zero value. Whereupon the previously stored tiled data is immediately unlocked and used by the graphics driver and the comparator C6 is reassigned from the assigned surface Si. This second manner of use, which essentially ignores the data stored in the assigned surface Si, eliminates the reading of the untiled data in surface Si and processing that data into the tiled format to overwrite the existing tiled data. Recognizing that the data in the assigned surface Si has not been changed through a write operation, allows these redundant steps to be eliminated, since tiling the untiled data would only reproduce the tiled data already existing in the tiled format from which the untiled data stored in the surface Si was created. Accordingly, the use and implementation of the access flag register 30 enhances the overall processing speed by eliminating redundant format tiling processing where frame buffer data has not been changed.

In the MAC operating system environment, the graphics driver 20 stores data into the surfaces defined within the frame buffer 22 in a synchronized manner under MAC os. Certain parts of the frame buffer may be asynchronously accessed by the os/application via the host data path. When the graphics driver wishes to access data in these areas of the frame buffer, it normally must first perform a synchronization operation to ensure it is accessing the latest version of the data. With the use of write access flags, each time the graphics driver might potentially need to perform a resynchronizing operation, it first checks the corresponding write access flag. If the write access flag W is set, the graphics driver 20 first conducts a resynchronizing process of the data in surface Si and when completed resynchronizing clears the write access. If the write access flag W is clear, the graphic processing circuitry 20 uses the data in surface Si directly without any synchronizing.

For the example illustrated in FIG. 2, if surface Si had been assigned to comparator C3, the graphics driver 20 recognizes that the data in surface Si has been both read and written to, since both the read access flag R and the write access flag W values are one for C3. In that case, the graphics driver uses the data in surface Si after it first conducts a resynchronizing process. The access flags R and W for comparator C3 would then be reset with a value of zero indicating clear. The flag reset can be done in conjunction with a reassignment of another surface to comparator C3.

On the other hand, if assigned surface Si was assigned to comparator C5, the graphics driver will directly use the data in surface Si since the write access flag W indicates clear, i.e. having a value zero. In that case, the resynchronizing processing is eliminated. Thus the use of write access flags W enables the elimination of redundant resynchronization of frame buffer data where such data has not been accessed at all, or has been accessed, but not written to via the host data path 24 in the MAC operating system environment.

Irrespective of operating system environment, the utilization of the write access flags W facilitates the elimination of redundant processing steps. Although the additional processing steps of setting the flags and checking the access flag register 30 are added to the overall processing, such steps utilize an insignificant amount of time when compared to the overall time savings achieved to the elimination of redundant data processing steps.

What is claimed is:

1. A graphic accelerator interface device comprising:

a video signal output;

a graphics driver coupled to said output;

a frame buffer for storing blocks of data used by said graphics driver to generate a video output signal;

a host data path associated with a CPU input and coupled to said frame buffer for facilitating os/application reading and writing data access thereto;

said host data path including a plurality of comparators, each assignable to a different surface to enable OS/application access to the assigned surface, each surface defined by an address range corresponding to a block of data in said frame buffer;

an access flag register associated with said host data path having at least a write flag with clear and set states associated with each surface assigned to a comparator, such that when said frame buffer is written to via said host data path at an address within the address range of an assigned surface, the corresponding write access flag is set; and said graphics driver using data blocks stored in said frame buffer which correspond to said address ranges of assigned surfaces in a first manner when the corresponding write flag is clear and in a second manner when the corresponding write flag is set.

2. A graphic accelerator interface device according to claim 1 wherein each write flag is reset to clear after said graphics driver uses the data block stored in said frame buffer which corresponds to the write flag's corresponding assigned surface address range in said second manner.

3. A graphic accelerator interface device according to claim 1 wherein said graphics driver stores blocks of data in a tiled format for normal use and locks, processes and writes the tiled data into a selected surface of said frame buffer in an untiled format to enable os/application access via said host data path, and, after os/application access to said selected surface is completed and dependent upon the state of the corresponding write access flag, said graphics driver uses data stored in said selected surface of said frame buffer in said first manner by ignoring it and unlocks the previous stored tiled formatted data for use, or uses data stored in said selected surface in said second manner by processing it into a tiled format for use in place of said previously stored tiled format data.

4. A graphic accelerator interface device according to claim 1 wherein said graphics driver stores synchronized data into a selected surface of said frame buffer and, after said selected surface has been assigned for os/application access via said host data path and dependent upon the state of the corresponding write access flag, uses data stored in said selected surface of said frame buffer in said first manner by directly using it, or uses data stored in said selected surface in said second manner by re-synchronizing the data before use.

5. A graphic accelerator interface device according to claim 1 wherein said access flag register includes read flags, each associated with an assigned surface such that when data stored in said frame buffer at an address range of the corresponding assigned surface is read via said host data path, the read flag is set.

6. A graphic accelerator interface device according to claim 1 wherein said comparators have dynamically assignable address ranges such that each surface is assignable to any of said comparators.

7. A graphic accelerator interface device according to claim 6 wherein eight comparators are provided, each comparator being comprised of an upper address comparator and a lower address comparator which are assigned the highest and lowest addresses, respectively, of the address range for the assigned surface, and said access flag register has eight corresponding write flags.

8. A graphic accelerator interface device according to claim 6 wherein said frame buffer has a size of sixty four megabytes.

9. A graphic accelerator interface device according to claim 1 configured as an add-in card wherein said video signal output comprises a video signal output port and said CPU input comprises card edge contacts.

10. A graphic accelerator interface device according to claim 1 incorporated into a computer system wherein said video signal output is coupled to a video display of the computer system.

11. A graphic accelerator interface device according to claim 1 incorporated into a computer system wherein said video signal output is a video output port.

12. A method for accelerating the processing of a video signal by graphic accelerator processing circuitry which stores blocks of data in a frame buffer to generate the video signal where the frame buffer is accessible to os/applications via a host data path comprising:

said graphic processing circuitry storing data in the frame buffer in blocks identified as surfaces having predefined address ranges;

said host data path assigning surfaces for access to permit reading and writing of data to assigned surfaces via said host data path;

registering whether a write to an assigned surface has occurred with an access flag associated with the assigned surface such that the write flag is initialized as clear and is set when a write occurs; and said graphic processing circuitry using data stored in assigned surfaces in a first manner when the corresponding write flag is clear and in a second manner when the corresponding write flag is set.

13. A method according to claim 12 further comprising, after the graphic processing circuitry uses data stored in an assigned surface in the second manner, reinitializing the corresponding write flag.

14. A method according to claim 12 further comprising:

said graphic processing circuitry storing blocks of data in a tiled format and locking, processing and writing such data into a selected surface of the frame buffer in an untiled format when os/application access via said host data path is required; and after os/applications access of the selected surface is completed and dependent upon the state of the corresponding write access flag, said graphic processing circuitry using data stored in the selected surface in the first manner by ignoring it and unlocking the previous cached tiled formatted data for use or using data stored in the selected surface in the second manner by processing it into a tiled format for use in lieu of said previously stored tiled format data.

15. A method according to claim 12 further comprising:

said graphic processing circuitry storing synchronized data into a selected surface of the frame buffer for os/application access via said host data path; and after the os/application access of the selected surface and dependent upon the state of the corresponding write access flag, said graphic processing circuitry accessing data stored in the selected surface in the first manner by directly using it or accessing data stored in the selected surface in the second manner by resynchronizing the data before use.

* * * * *